US010151225B2

(12) United States Patent
Wu et al.

(10) Patent No.: US 10,151,225 B2
(45) Date of Patent: Dec. 11, 2018

(54) INTEGRATED OIL SEPARATOR ASSEMBLY FOR CRANKCASE VENTILATION

(71) Applicant: GM Global Technology Operations LLC, Detroit, MI (US)

(72) Inventors: Ko-Jen Wu, West Bloomfield, MI (US); Jason C. Melecosky, Oxford, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 58 days.

(21) Appl. No.: 15/334,840

(22) Filed: Oct. 26, 2016

(65) Prior Publication Data

US 2018/0112567 A1 Apr. 26, 2018

(51) Int. Cl.
*F01M 13/04* (2006.01)
*F01M 11/08* (2006.01)
(Continued)

(52) U.S. Cl.
CPC ..... *F01M 13/04* (2013.01); *F01M 11/08* (2013.01); *F01M 13/022* (2013.01);
(Continued)

(58) Field of Classification Search
CPC ..... F01M 11/08; F01M 2011/038; F01M 2013/0038; F01M 2013/0044;
(Continued)

(56) References Cited

U.S. PATENT DOCUMENTS 5,564,401 A * 10/1996 Dickson ..... F01M 13/023 123/573
6,478,019 B2 * 11/2002 Fedorowicz ..... F01M 13/0416 123/572
(Continued)

FOREIGN PATENT DOCUMENTS

DE 202017101622 U1 * 3/2017 ..... F01M 13/0011
EP 0978639 A1 * 2/2000 ..... F01M 13/0416

OTHER PUBLICATIONS

Polytec, DE202017101622, Mar. 27, 2017, machine translation.*
(Continued)

*Primary Examiner* — Hung Q Nguyen
*Assistant Examiner* — Mark L Greene
(74) *Attorney, Agent, or Firm* — Harness, Dickey & Pierce, P.L.C.

(57) ABSTRACT

An internal combustion engine includes an engine block defining a plurality of cylinders each receiving a piston. A crankcase extends from the engine block and supports a crankshaft drivingly connected to the pistons and including a chamber enclosed by a wall portion that defines a first blow-by flow passage and first and second drain passages therethrough. An oil sump mounted to the crankcase. A first oil separator is mounted to the wall of the crankcase in communication with the first blow-by flow passage and the first drain passage and defining a second blow-by flow passage therethrough and a third drain passage extending therethrough in communication with the second drain passage. A second oil separator mounted to the first oil separator
(Continued)

in communication with the third drain passage and defining a third blow-by flow passage in communication with the second blow-by flow passage.

8 Claims, 4 Drawing Sheets

(51) Int. Cl.
*F01M 13/02* (2006.01)
*F01M 13/00* (2006.01)

(52) U.S. Cl.
CPC ..... *F01M 13/0405* (2013.01); *F01M 13/0416* (2013.01); *F01M 2013/0072* (2013.01); *F01M 2013/0433* (2013.01); *F01M 2013/0438* (2013.01); *F01M 2013/0488* (2013.01)

(58) Field of Classification Search
CPC ..... F01M 2013/005; F01M 2013/0055; F01M 2013/0061; F01M 2013/0066; F01M 2013/0072; F01M 2013/0438; F01M 11/03; F01M 2011/031; F01M 13/00; F01M 13/0011; F01M 13/0033; F01M 13/04; F01M 13/0416; F01M 2013/0461; F01M 13/022; F01M 13/0405; F01M 2013/0433; F01M 13/0488
USPC ..... 123/41.86, 195 C, 196 R, 198 E
See application file for complete search history.

(56) References Cited

U.S. PATENT DOCUMENTS

| | | | | |
|---|---|---|---|---|
| 7,243,642 | B2 * | 7/2007 | Nishikawa | F01M 13/0416 123/572 |
| 9,151,195 | B2 * | 10/2015 | Statter | F01M 13/0405 |
| 2014/0109885 | A1 * | 4/2014 | Kalayci | F01M 13/0011 123/572 |
| 2014/0366855 | A1 * | 12/2014 | Kitagawa | F01M 13/0416 123/572 |
| 2016/0376950 | A1 * | 12/2016 | Kira | F01M 13/04 123/573 |
| 2017/0175601 | A1 * | 6/2017 | Usa | F01M 13/04 |
| 2017/0370256 | A1 * | 12/2017 | Tokunaga | F01P 3/12 |

OTHER PUBLICATIONS

Haack, EP0978639, Feb. 9, 2000, machine translation.*
Highly Efficient Oil Separation Systems for Crankcase Ventilation; G. Kissner and S. Ruppel; © 2009 SAE International; 2009-01-0974 (7 pages).
Engine Lube-Oil Consumption Stakes and Benefits from Significant Blow-by Oil Mist Reduction; N. Arnault and S. Bonne; © 2012 SAE International; 2012-01-1617 (14 pages).
Fundamental Approach to Investigate Pre-Ignition in Boosted SI Engines; A. Zandeh, P. Rothenberger, W. Nguyen, M. Anbarasu, S. Schmuck-Soldan, J. Schaefer, T. Goebel; © 2011 SAE International; 2011-01-0340 (28 pages).

* cited by examiner

INTEGRATED OIL SEPARATOR ASSEMBLY FOR CRANKCASE VENTILATION

FIELD

The present disclosure relates to an oil separator assembly for a crankcase ventilation system.

BACKGROUND

This section provides background information related to the present disclosure which is not necessarily prior art.

The trend of more stringent future $CO_2$ legislations is accelerating the pace of the industry in adopting the engine downsizing strategy. For a downsized engine to maintain the same vehicle's performance, the engine needs to be boosted either by turbocharging or supercharging. It has been observed that boosted engines have a higher propensity in running into an abnormal combustion phenomena referred to in the literature as pre-ignition, which can result in high noise levels or damage to the engine. One hypothesis of the causes of pre-ignition is the presence of oil in the combustion chamber.

Another issue from the presence of oil droplets in the combustible mixtures is that they can result in the formation of particulates as a combustion byproduct. Due to potential health concerns, more stringent legislations are being developed, which may mandate expensive on-board exhaust filtration systems if proper measures cannot be developed to control oil contents in the combustion chamber.

One source of combustion chamber oil is from crankcase ventilation. The crankcase ventilation system typically includes an oil separation system to remove oil from the recirculated blowby gases. Due to the demand to improve oil separation, oil separation systems have evolved from a single-stage passive system to the current two-stage design. Active systems have also been demonstrated.

The present disclosure regards a passive two-stage oil separation system.

SUMMARY

This section provides a general summary of the disclosure, and is not a comprehensive disclosure of its full scope or all of its features.

An internal combustion engine, includes an engine block defining a plurality of cylinders each receiving a piston. A crankcase extends from the engine block and supports a crankshaft drivingly connected to the pistons and including a chamber enclosed by a wall portion that defines a first blow-by flow passage and first and second drain passages therethrough. An oil sump mounted to the crankcase. A first oil separator is mounted to the wall of the crankcase in communication with the first blow-by flow passage and the first drain passage and defining a second blow-by flow passage therethrough and a third drain passage extending therethrough in communication with the second drain passage. A second oil separator mounted to the first oil separator in communication with the third drain passage and defining a third blow-by flow passage in communication with the second blow-by flow passage.

The first, or upstream, oil separator is preferably directly mounted to the engine crankcase or block to allow the shortest paths for blow-by gases to reach the separators. Any oil that gets separated from the blowby flow can drain back to the crankcase through the first drain passage provided in the block/crankcase structure.

The second, or downstream, oil separator is preferably mounted to the first oil separator directly with the second blow-by flow passage between the two to allow the blow-by gases to continue to flow through the system to have the remaining oil contents further removed. Like the first separator, the second separator can have at least one oil filtering element and/or impactor along winding passages. A pressure regulator is incorporated in the second separator to ensure proper crankcase pressures. The end of the flow passage of this separator is connected to a vacuum source which can be the intake manifold of a naturally aspirated engine or both the intake manifold and a pre-compressor location of a turbocharged engine. Additional check valve(s) can be incorporated in the second separator if required.

The blowby gas flow passages in the separators are properly designed so the same passages can be used for oil to drain back to the engine by gravity. For this integrated system, the first oil separator also incorporates an internal drain passage to serve as the third oil drain passage from the second oil separator. This third oil drain passage is isolated from the blowby gases and properly sealed at the interfaces between the two oil separators and between the first oil separator and the engine, due to the pressure differences between the two oil separators. The third oil drain passage communicates with the second oil drain passage into the engine crankcase and needs to be isolated from the crankcase pressures, which can be commonly done by submerging the end of the drain pipe to below the oil level in the crankcase.

In the simplest design of the second oil separator, the oil and blowby gases can share the same passages, provided that the passages are properly designed to allow proper oil flow. Further embodiment includes multiple isolated oil drain passages built in the oil separator to allow oil drain back from multiple locations along the blowby gas passages of the oil separator.

The oil drain passage from the second oil separator can also be routed externally from the separator to the crankcase. For the same reason provided above, the crankcase end of the passage can be attached to the crankcase at a location below the oil level. This arrangement has the risk of losing engine oil if the passage gets damaged during service. To reduce such risks, alternatively the external passage can be attached to the crankcase/block at a location above the oil level and followed by an internal passage to below the oil level.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
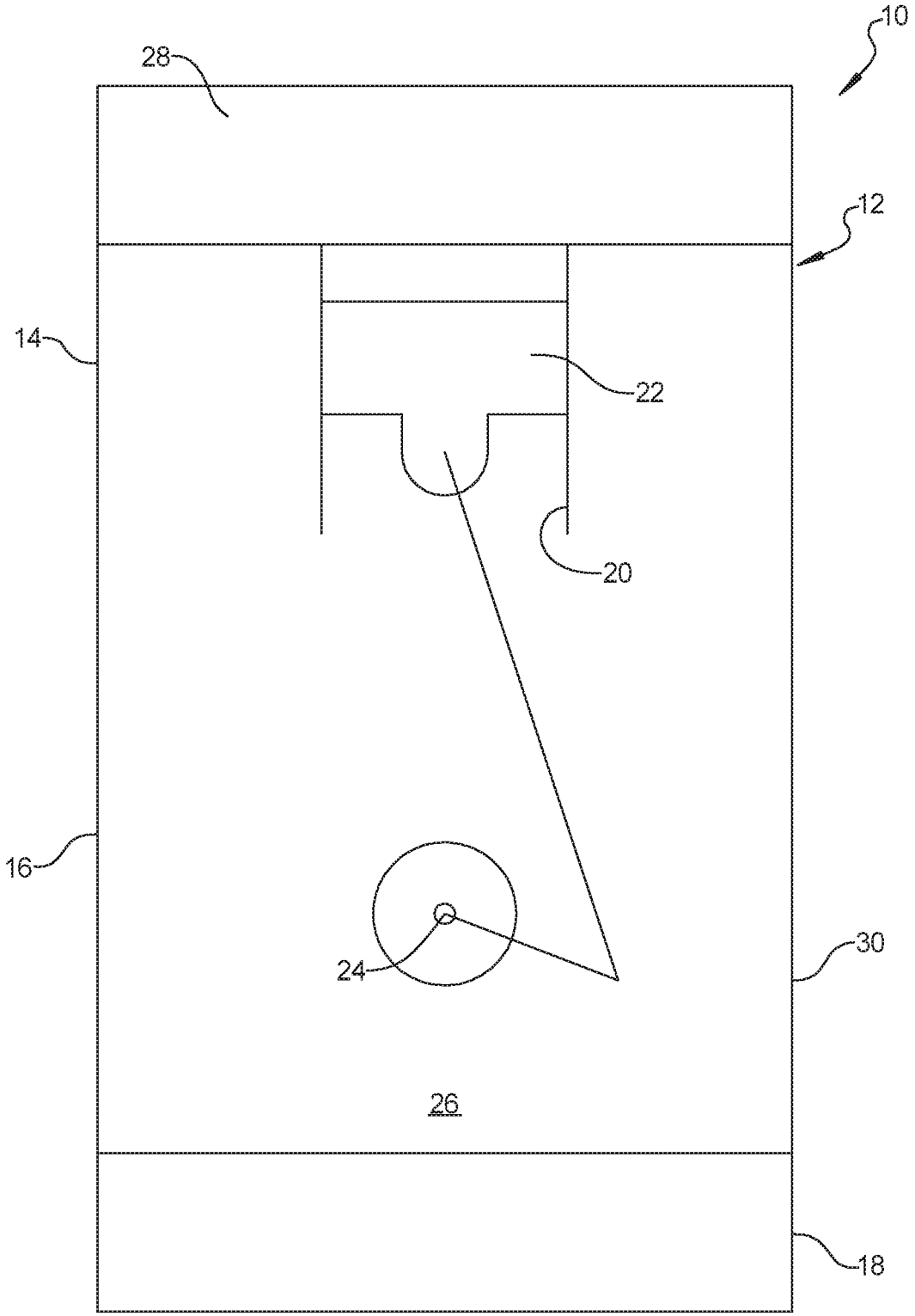
FIG. 1 is a schematic view of an engine according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, an internal combustion engine system 10 is shown including an engine structure 12 that can include a cylinder block 14, a crankcase 16 below the cylinder block 14 and an oil pan 18 below the crankcase 16. The cylinder block 14 defines a plurality of cylinders 20 each of which includes a piston 22 disposed therein. A crankshaft 24 is connected to the pistons 22 for driving connection therewith. The crank case 16 defines a chamber 26 in which the crankshaft 24 is rotatably supported. A cylinder head 28 is mounted to the cylinder block 14.

Figure 2:
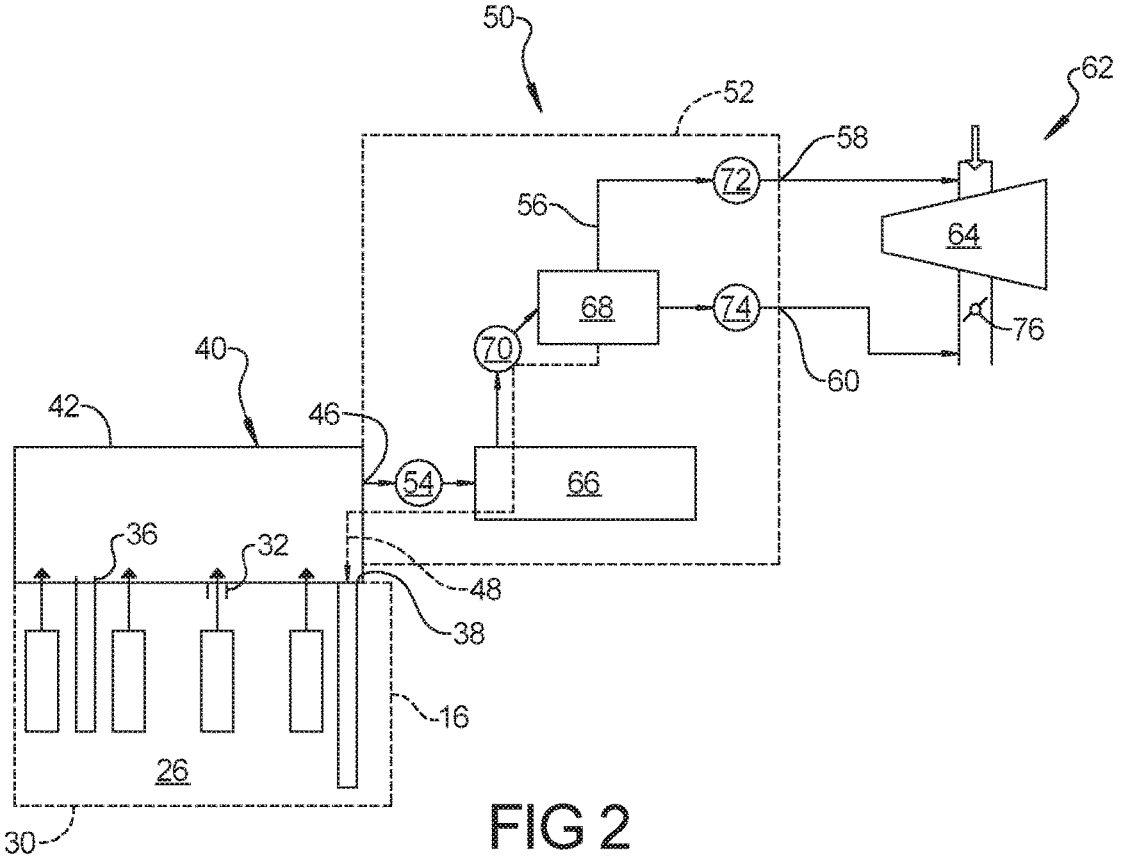
FIG. 2 is a schematic view of the two oil separators according to the principles of the present disclosure.
Figure 3:
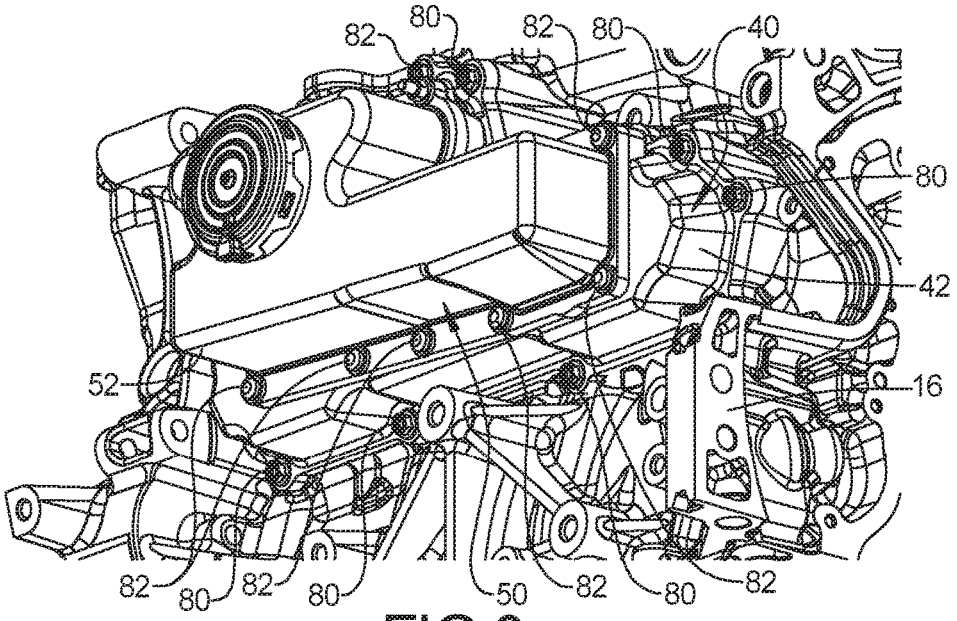
FIG. 3 is a perspective view of the oil separator assembly mounted to an engine crankcase according to the principles the present disclosure.
Figure 4:
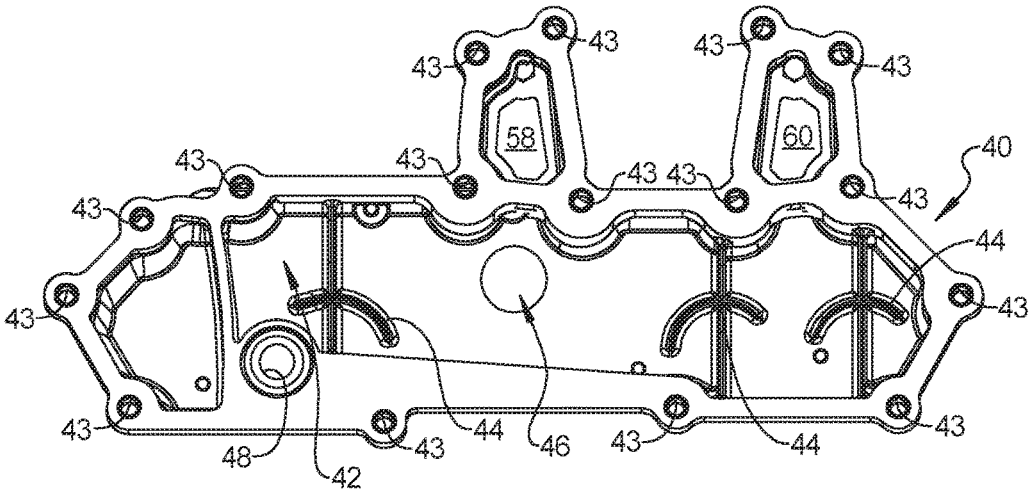
FIG. 4 is a plan view of the interior of the first oil separator according to the principles of the present disclosure.
Figure 5:
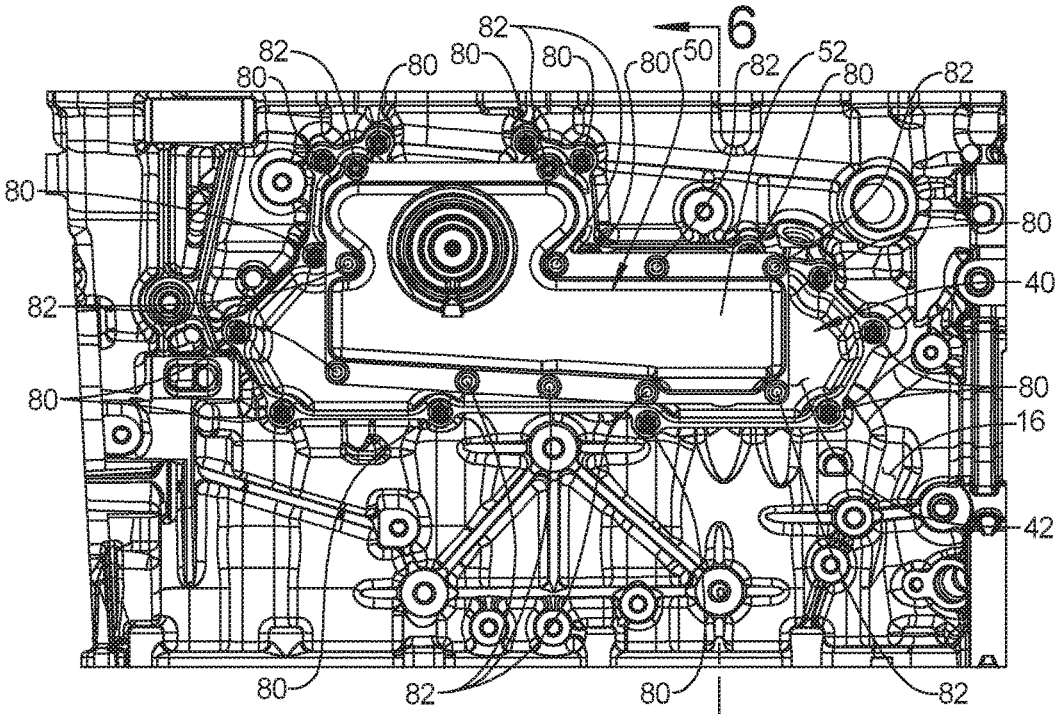
FIG. 5 is a plan view of the oil separator assembly mounted to the engine crankcase according to the principles of the present disclosure.
Figure 6:
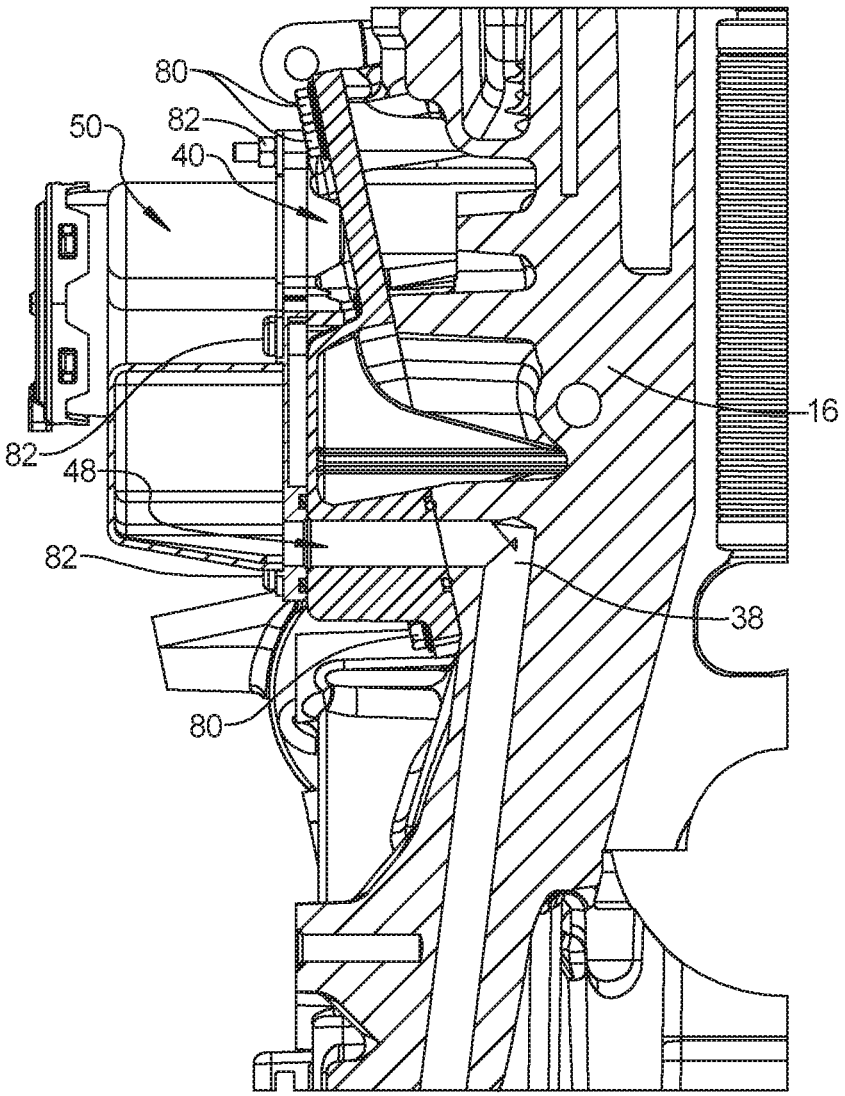
FIG. 6 is a partial cross-sectional view of the oil separator assembly mounted to an engine crankcase according to the principles of the present disclosure.

With reference to FIG. 2, the crankcase 16 includes a wall portion 30 enclosing the chamber 26. A first blow-by flow passage 32 extends through the wall portion 30. In addition, first and second drain passages 36, 38 extend through the wall portion 30. A first oil separator 40 includes a mounting flange with a plurality of mounting holes that is mounted to the crankcase 16 or other component of the engine, such as the cylinder block or cylinder head in communication with the first blow-by flow passage 32 and the first drain passage 36. As best shown in FIG. 4, the first oil separator 40 includes a wall structure 42 having a plurality of internal baffles 44 extending therefrom and a second blow-by flow passage 46 and a third drain passage 48 extending therethrough. The third drain passage 48 is in communication with the second drain passage 38.

A second oil separator 50 is mounted to the wall structure 42 of the first oil separator 40 and in communication with the third drain passage 48. The second oil separator 50 includes a wall structure 52 and can include a plurality of internal baffles or a filter 54 in communication with a third blow-by flow passage 56. The third blow-by flow passage 56 can be in communication with one or more openings 58, 60 in the wall structure 52 that can provide the blow-by flow to an air intake system 62 that can include a turbocharger 64. The second separator 50 can include a first volume 66 and a second volume 68 that can be separated by a pressure regulator valve 70. The second volume 68 is in communication with the openings 58, 60 via a pair of check valves 72, 74, respectively. The openings 58, 60 can be in communication with the air intake system 62 at a location upstream of the turbocharger 64 or at a location downstream of a throttle valve 76.

Each of the wall structures 42, 52 of the first and second oil separators 40, 50 can include a mounting flange 42*a*, 52*a*, respectively. Each mounting flange 42*a*, 52*a* includes a plurality of mounting holes 43, 53 extending therethrough. The mounting holes 43 of the first oil separator 40 receive fasteners 80 that engage the engine crankcase 16. The mounting holes 53 of the second oil separator receive fasteners 82 that engage threaded bores in the wall structure 42 in the first oil separator 40.

The proposed integrated system is expected to provide reduced costs since only one machined mounting face is required on the surface of the engine structure. The design of the present disclosure also provides improved packaging and easy installation.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An internal combustion engine, comprising:

an engine block defining a plurality of cylinders each receiving a piston;

a chamber extending from the engine block, the chamber supporting a crankshaft drivingly connected to the pistons and the chamber including a wall portion that defines a first blow-by flow passage and a first drain passage and a second drain passage therethrough;

an oil sump mounted to the wall portion of the chamber;

a first oil separator mounted to the wall portion of the chamber in communication with the first blow-by flow passage and the first drain passage and defining a second blow-by flow passage therethrough and a third drain passage extending therethrough and in communication with the second drain passage;

a second oil separator mounted to the first oil separator in communication with the third drain passage and defining a third blow-by flow passage in communication with the second blow-by flow passage.

2. The internal combustion engine according to claim 1, wherein the first oil separator includes a first mounting flange with a plurality of mounting holes therein, the first mounting flange being connected to the engine.

3. The internal combustion engine according to claim 2, wherein the second oil separator includes a second mounting flange with a plurality of mounting holes, the second mounting flange being connected to the first oil separator.

4. The internal combustion engine according to claim 1, further comprising at least one of a filter and a baffle in the first oil separator.

5. The internal combustion engine according to claim 4, further comprising at least one of a filter and a baffle in the second oil separator.

6. The internal combustion engine according to claim 1, wherein the second oil separator is in communication with at least one vacuum source passage in communication with an air intake system of the engine.

7. The internal combustion engine according to claim 6, wherein the second oil separator includes a check valve in communication with the at least one vacuum source passage.

8. The internal combustion engine according to claim 1, further comprising a pressure regulator valve disposed in the second oil separator.

* * * * *